US008684433B2

(12) United States Patent
Oesterle et al.

(10) Patent No.: US 8,684,433 B2
(45) Date of Patent: Apr. 1, 2014

(54) PACKAGING FOR MULTIPLE MEDICAL CONTAINERS

(75) Inventors: Thomas Oesterle, Colorado Springs, CO (US); Lillian G. Zakarija, Northbrook, IL (US); Chinmay Kanuga, Porter Ranch, CA (US)

(73) Assignees: Baxter International Inc., Deerfield, IL (US); Baxter Healthcare SA, Glattpark (Opfikon) (CH)

( * ) Notice: Subject to any disclaimer, the term of this patent is extended or adjusted under 35 U.S.C. 154(b) by 21 days.

(21) Appl. No.: 13/456,341

(22) Filed: Apr. 26, 2012

(65) Prior Publication Data

US 2013/0284735 A1 Oct. 31, 2013

(51) Int. Cl.
*B65D 21/024* (2006.01)
*B65D 69/00* (2006.01)

(52) U.S. Cl.
USPC ..... 294/163; 294/165; 294/87.2; 206/570; 220/23.83

(58) Field of Classification Search
USPC ..... 294/87.2, 146, 159, 162, 163, 165; 206/159, 570; 220/23.83, 23.86, 740
See application file for complete search history.

(56) References Cited

U.S. PATENT DOCUMENTS

| | | | | |
|---|---|---|---|---|
| 363,690 | A | 5/1887 | Sleeper | |
| 2,080,947 | A * | 5/1937 | Ligeour | 294/87.2 |
| 2,399,893 | A * | 5/1946 | Scholz | 206/142 |
| 2,754,962 | A * | 7/1956 | Scrymgeour | 206/162 |
| 2,865,669 | A | 12/1958 | Linthicum | |
| 2,949,204 | A * | 8/1960 | Edwards | 215/321 |
| 3,278,007 | A | 10/1966 | Weber | |
| 3,589,509 | A * | 6/1971 | Mascia et al. | 206/151 |
| 3,593,873 | A | 7/1971 | Vonk | |
| 3,601,253 | A * | 8/1971 | Poupitch | 206/153 |
| 3,727,749 | A | 4/1973 | Martin | |
| 3,744,661 | A | 7/1973 | Fischer, Jr. | |
| 3,893,280 | A | 7/1975 | King | |
| 4,143,764 | A | 3/1979 | Moss, III | |
| 4,262,814 | A | 4/1981 | Roccaforte | |
| 4,856,647 | A * | 8/1989 | Dahne | 206/5.1 |

(Continued)

FOREIGN PATENT DOCUMENTS

| | | |
|---|---|---|
| EP | 0495808 | 7/1992 |
| EP | 0631816 | 1/1995 |

(Continued)

OTHER PUBLICATIONS

International Search Report and Written Opinion from corresponding International Application No. PCT/US2013/036879, mail date Jul. 26, 2013.

*Primary Examiner* — Dean Kramer
(74) *Attorney, Agent, or Firm* — Marshall, Gerstein & Borun LLP

(57) ABSTRACT

A system includes a first container having a wall defining a receptacle, a neck defining an opening, and a flip cap disposed over the opening, and a second container having a wall defining a receptacle, a neck defining an opening, and a flip cap disposed over the opening. The system also includes a carrier having first and second carrier pieces disposed about the first and second containers and attached together with the first and second containers secured therebetween. The system further includes a top cap attached to the flip caps to secure the first and second containers together and to simultaneously remove the flip caps from the containers.

13 Claims, 7 Drawing Sheets

(56) References Cited

U.S. PATENT DOCUMENTS

| | | | | |
|---|---|---|---|---|
| 5,005,721 | A | 4/1991 | Jordan | |
| 5,009,309 | A | 4/1991 | Hansen | |
| 5,040,678 | A | 8/1991 | Lenmark, Sr. et al. | |
| 5,148,919 | A | 9/1992 | Rubin | |
| 5,609,248 | A | 3/1997 | Rohrbough et al. | |
| 5,725,499 | A | 3/1998 | Silverstein et al. | |
| 5,954,213 | A | 9/1999 | Gerhart et al. | |
| 6,000,548 | A | 12/1999 | Tsals | |
| 6,102,233 | A | 8/2000 | Waugh | |
| 6,164,450 | A | 12/2000 | Benedetti | |
| 6,213,529 | B1 * | 4/2001 | Kurcz et al. | 294/143 |
| 6,305,541 | B1 | 10/2001 | Tanner et al. | |
| 6,558,628 | B1 | 5/2003 | Reo | |
| 6,613,283 | B2 | 9/2003 | Reo | |
| 6,789,828 | B1 * | 9/2004 | Borg | 294/87.2 |
| 6,929,474 | B2 | 8/2005 | Schenck et al. | |
| 7,468,049 | B2 | 12/2008 | Laveault | |
| 2005/0045495 | A1 | 3/2005 | Dalsing et al. | |
| 2007/0278245 | A1 | 12/2007 | Brooks et al. | |

FOREIGN PATENT DOCUMENTS

| | | |
|---|---|---|
| EP | 0734963 | 10/1996 |
| FR | 2085307 | 12/1971 |
| FR | 2715131 | 7/1995 |
| JP | 08-324571 | 12/1996 |
| WO | WO 93/01739 | 2/1993 |
| WO | WO96/32917 | 10/1996 |
| WO | WO 2009/083347 | 7/2009 |

* cited by examiner

PACKAGING FOR MULTIPLE MEDICAL CONTAINERS

BACKGROUND

The present disclosure relates generally to packaging for a plurality of medical containers and, more specifically, to packaging for the plurality of medical containers that limits separation of the containers at least prior to use.

Some drugs are intended for concurrent use. For example, a first drug may be administered initially to improve the conditions under which a second drug is delivered to or processed by a patient. Conventionally, this requires the healthcare professional administering the drugs to collect the drugs from storage, to verify the identity of the drugs, to verify the concentration of the drugs, and then to perform the administration of the drugs.

As a consequence, there are a number of issues that may arise. The professional may obtain the incorrect drugs, or may misidentify the drugs. He or she may also fail to misidentify the concentration of the drugs. Having collected the drugs and identified them correctly, he or she may also fail to transport them to the patient. The bottles, vials or other containers may be mishandled, and could even end up damaged or broken. Any of these issues may have a negative effect on the administration of the drugs to the patient, and on the health of the patient.

As set forth in more detail below, the present disclosure sets forth an improved packaging device embodying advantageous alternatives to the conventional packaging assemblies discussed above.

SUMMARY

According to an aspect of the present disclosure, a system includes a first container having a wall defining a receptacle, a neck defining an opening, and a flip cap disposed over the opening, and a second container having a wall defining a receptacle, a neck defining an opening, and a flip cap disposed over the opening. The system also includes a carrier having first and second carrier pieces disposed about the first and second containers and attached together with the first and second containers secured therebetween. The system further includes a top cap attached to the flip caps to secure the first and second containers together and to simultaneously remove the flip caps from the containers.

Additional aspects of the disclosure are defined by the claims of this patent.

BRIEF DESCRIPTION OF THE FIGURES

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

FIG. 1 is an exploded perspective view of a device according to the present disclosure, including a carrier in two sections and two containers for drugs, medical fluids or the like;

DETAILED DESCRIPTION

Figure 1:
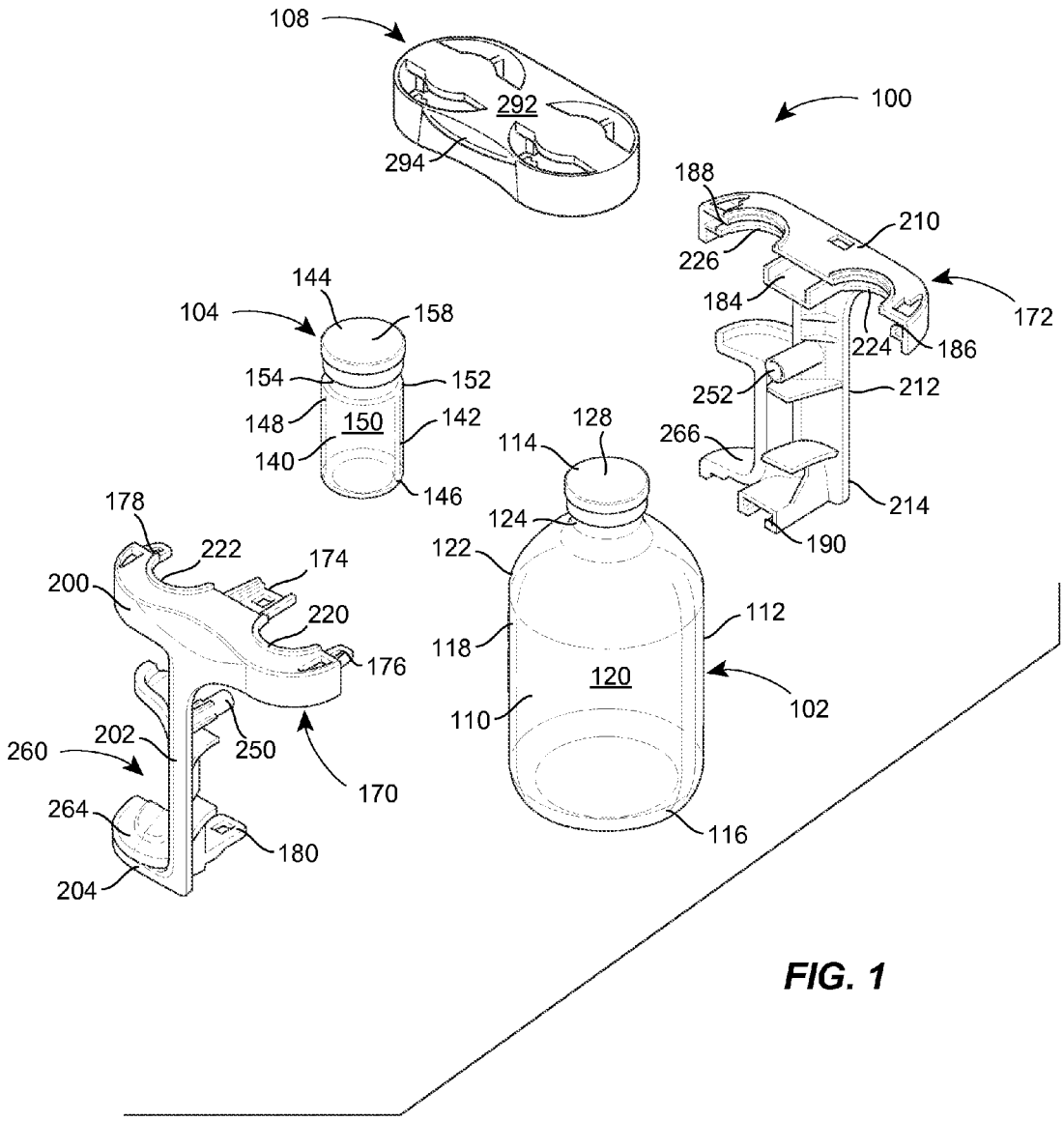
Figure 2:
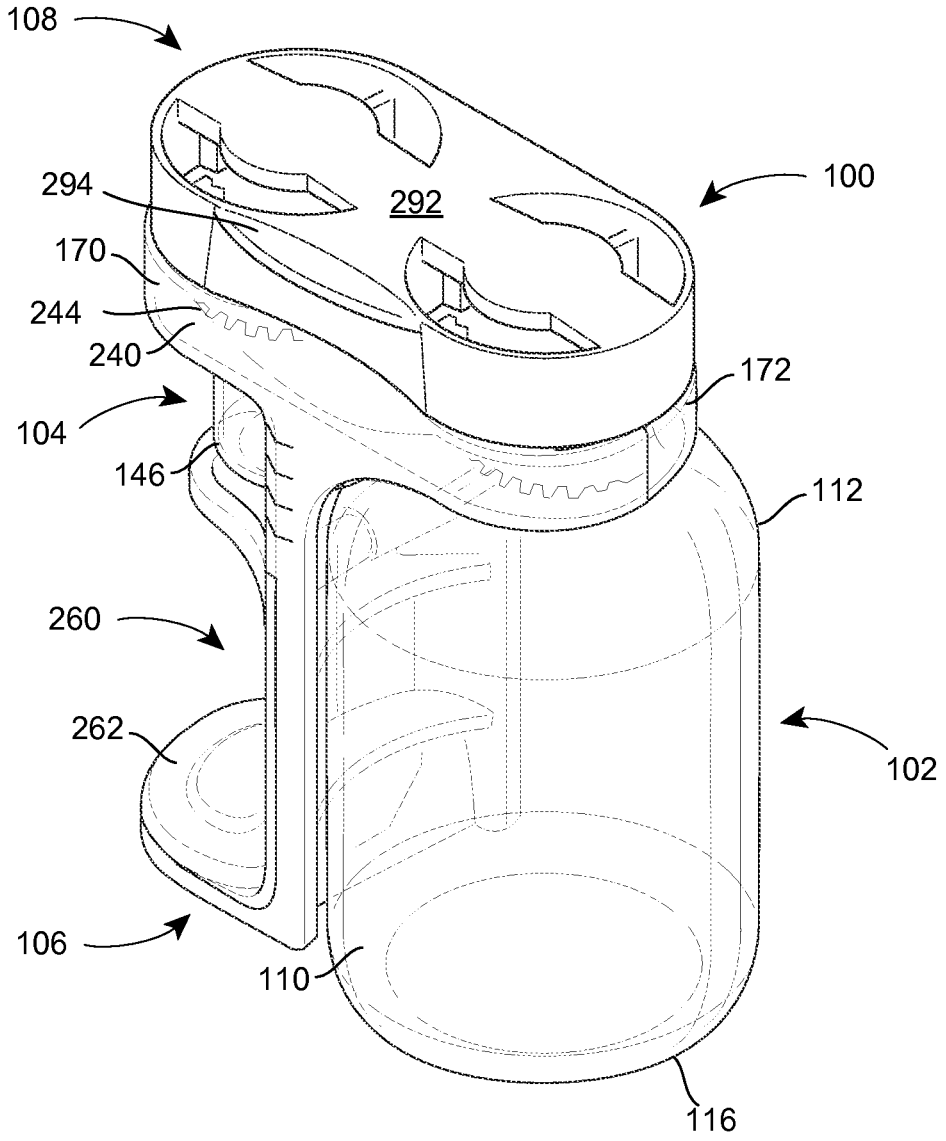
FIG. 2 is a perspective view of the device of FIG. 1 as assembled.

Referring first to FIGS. 1 and 2, a container system 100 according to the present disclosure generally includes a first container 102, a second container 104, a carrier 106 (see FIG. 2) and a top cap 108. The first container 102 may contain a first drug, while the second container 104 may contain a second drug, for example. The carrier 106 secures the first and second containers 102, 104 together at least until use. Similarly, the top cap 108 may also secure the first and second containers 102, 104 together at least until use, and may be removed to provide simultaneous access to the first and second containers 102, 104.

As to the details of the system 100, it will be recognized that the first container 102 has front portion 110, a back portion 112, a top 114, and a bottom 116. The back (or second) portion 112 is disposed opposite the front (or first) portion 110, while the bottom 116 is disposed opposite the top 114. Moreover, the container 102 includes a wall 118 that defines a receptacle 120, a shoulder 122, and a neck 124 (see also FIG. 11 in this regard). Each of these features has a front and a back portion in keeping with the front and back portions 110, 112 identified for the container 102. Further, the neck 124 forms an opening 126 having a passage defined therein (see FIG. 11), with a flip cap 128 disposed over the opening 126.

Figure 7:
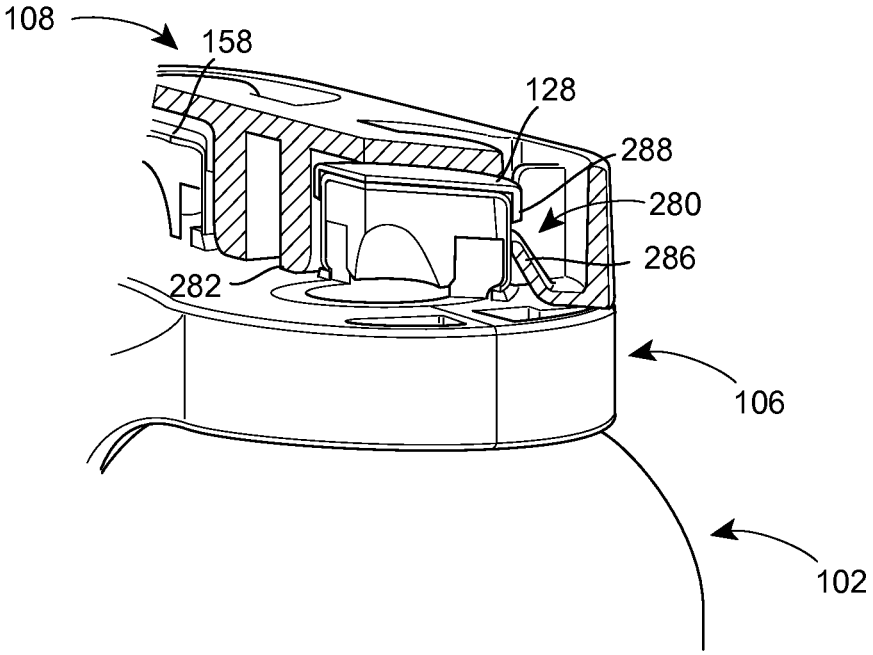
FIG. 7 is an enlarged, fragmentary, cross-sectional view of the device of FIG. 2, illustrating a top cap and its attachment to a flip cap of each of the containers.
Figure 8:
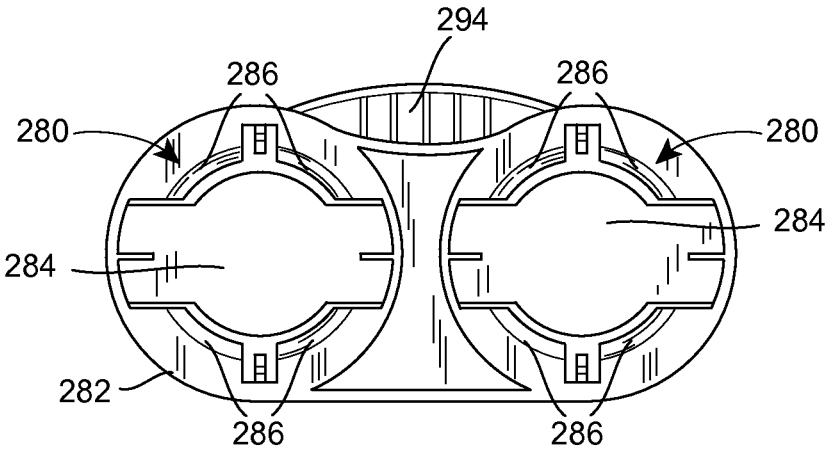
FIG. 8 is a bottom view of the top cap.
Figure 9:
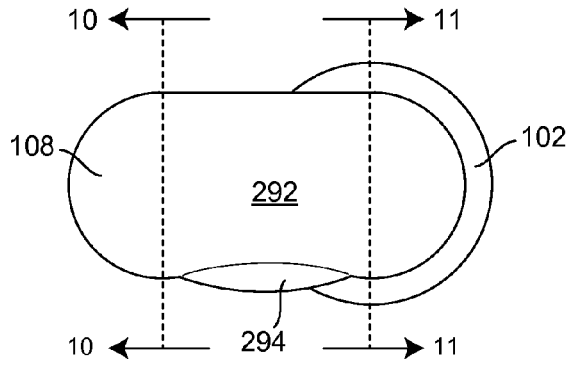
FIG. 9 is a plan view of the device of FIG. 2.

In a similar fashion, the second container 104 has a front portion 140, a back portion 142, a top 144, and a bottom 146. Moreover, the container 104 includes a wall 148 defining a receptacle 150, a shoulder 152, and a neck 154 (see also FIG. 10 in this regard). The neck 154 forms an opening in communication with a passage defined therein (see FIG. 10), and a flip cap 158 is disposed over the opening. It will also be recognized that a stopper may be disposed, at least partially, within the passage and held in place through the use of a crimp ring or flange (see FIGS. 7, 10 and 11). The crimp ring may, in turn, be attached to the flip cap 158.

While the first and second containers 102, 104 are generally cylindrical in shape, they may take the form of various other shapes and still be included within the scope of the disclosure. The containers, which may also be referred to as vials or bottles, may be made of glass or plastic, for example. Further, typically, the first container 102 may be a large container having a large volume of medication, and the second container 104 may be a small container having a small volume of medication. In other words, the volume of medication in the first container 102 is greater that the volume of medication in the second container 104. However, both volumes of medication may represent (and according to certain embodiments, are) a single dose.

In one example, the first container 102 may be a glass vial adapted to hold 100 mL of a Gammaguard liquid, and the second container 104 may be a glass vial adapted to hold 5 mL of a Hylenex liquid. These medications, however, are one example only. One of skill in the art will appreciate that the medications in the first and second containers 102, 104 may include various other medications and may be administered together in a single dose or multiple doses.

As mentioned above, the system 100 also includes a carrier 106 that is disposed about the first and second containers 102, 104 to secure the same together at least until use. As illustrated in FIG. 1, the carrier 106 includes a first carrier piece or section 170 and a second carrier piece or section 172. The containers 102, 104 are secured between the carrier pieces 170, 172 when the pieces 170, 172 are attached together and the carrier 106 is assembled (see FIG. 2). It will be recognized that while the first and second carrier pieces 170, 172 are disposed about the first and second containers 102, 104, the pieces 170, 172 may only partially surround the containers 102, 104 as explained in greater detail below.

Figure 5:
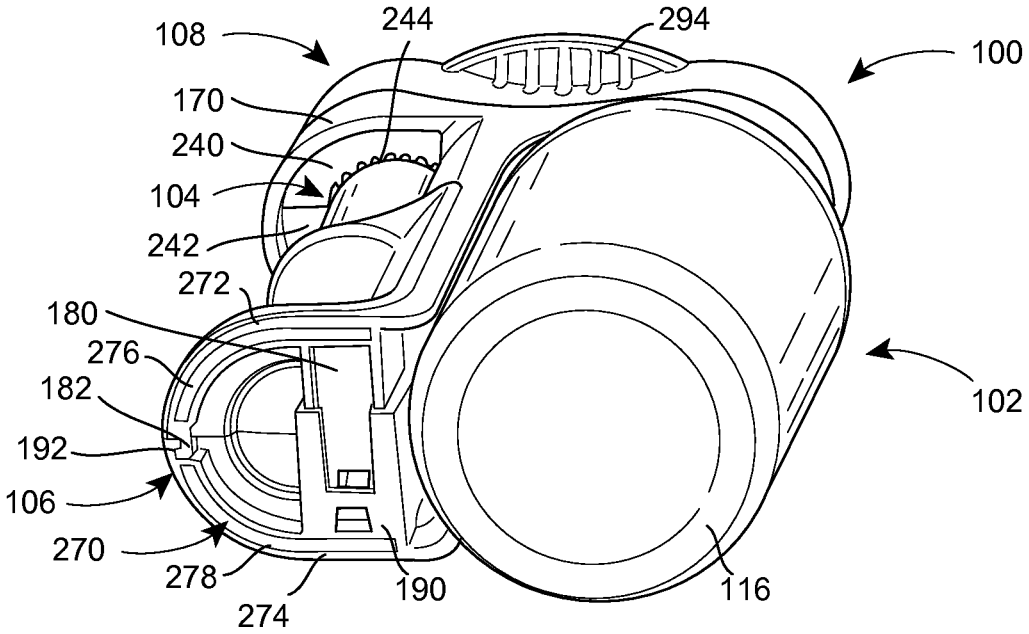
FIG. 5 is a bottom, perspective view of the device of FIG. 2.

According to the present disclosure and as best seen in FIG. 1, one of the first and second carrier pieces 170, 172 may include at least one latch, while the other may include at least one recess to receive the at least one latch. As illustrated in FIGS. 1 and 5, the first carrier piece 170 has five latches 174, 176, 178, 180, 182 (see FIGS. 5 as to 182), while the second carrier piece 172 has five recesses 184, 186, 188, 190, 192 (see FIGS. 5 as to 192) in which the latches 174, 176, 178, 180, 182 are disposed to attach the first and second carrier pieces 170, 172 together with the first and second containers 102, 104 secured therebetween. It will be recognized that this exemplary embodiment is not intended to be limiting in that the first carrier piece 170 includes only latches while the second carrier piece 172 includes only recesses; according to other embodiments, each piece 170, 172 may include one or more latches and one or more recesses. Furthermore, it will be recognized that while at least one latch and recess should be provided, it is not necessary to provide five latches and recesses as illustrated.

The latches 174, 176, 178, 180, 182 and recesses 184, 186, 188, 190, 192 may be disposed about the first and second carrier pieces 170, 172 in the following fashion.

The first carrier piece 170 has a top portion 200, a central portion 202, and a base portion 204, and the second carrier piece 172 likewise has a top portion 210, a central portion 212, and a base portion 214. The latch 174 of the first carrier piece 170 is disposed on a central area of the top portion 200, and the associated recess 184 of the second carrier piece 172 is disposed on a central area of the top portion 210. In addition, the top portion 200 of the first carrier piece 170 may include two additional latches 176, 178, one of which may be disposed on a first side of the top portion 200 and the other of which may be disposed on a second side of the top portion 200 opposite the first side (i.e., on opposite sides of the top portion 200 relative to the central area where the latch 174 is disposed). The recesses 186, 188 associated with these latches 176, 178 are disposed on opposite sides of the top portion 210 of the second carrier piece 172. Phrased slightly differently, the first latch/recess pair 174, 184 is disposed between the first and second containers 102, 104, with the first container 102 disposed between the latch/recess pairs 174, 184 and 176, 186 and the second container 104 is disposed between the latch/recess pairs 174, 184 and 178, 188.

As also seen in FIG. 1, the latch 180 and the recess 190 are disposed on the base portions 204, 214 of the first and second carrier pieces 170, 172, respectively. The final latch/recess pair 182, 192 is best viewed in FIG. 5, being located on the base portions 204, 214 of the first and second carrier pieces 170, 172, but viewable only with the carrier 106 turned on its side so that the very bottommost surface is visible.

In regard to the latch/ recess pairs 174, 184 and 180, 190, it will be noted that the recesses 184, 190 are U-shaped, which shape may assist in guiding the latches 174, 180 into the same and also may assist in smooth engagement of the latches 174, 180 and the associated recesses 184, 190. While the recesses 184, 190 are U-shaped as illustrated, one of skill in the art will appreciate that the recesses 184, 190 be formed using other shapes and still fall within the scope of the disclosure. Such shapes may include an inverted U-shape, a semicircle, and an inverted semi-circle, for example. As illustrated, the latches 174, 180 are loop latches, which deflect during assembly, thus keeping assembly forces low, but resisting release in tension and shear, for example. The connection between the latch/ recess pairs 174, 184 and 180, 190 may provide the majority of resistance to separation of the first and second carrier pieces 170, 172.

Figure 3:
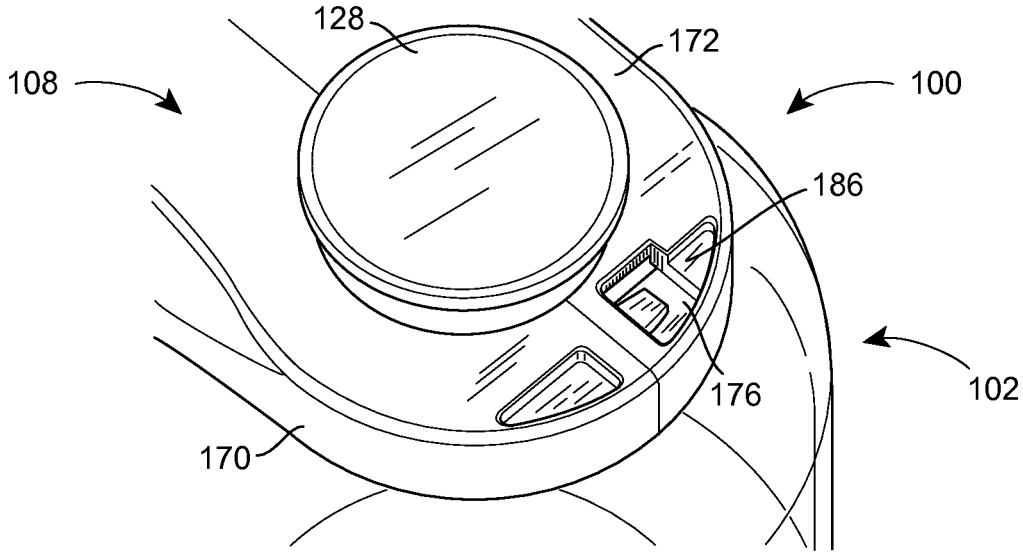
FIG. 3 is an enlarged, fragmentary perspective view of the device of FIG. 2 illustrating a lock used to secure the sections of the carrier together.
Figure 4:
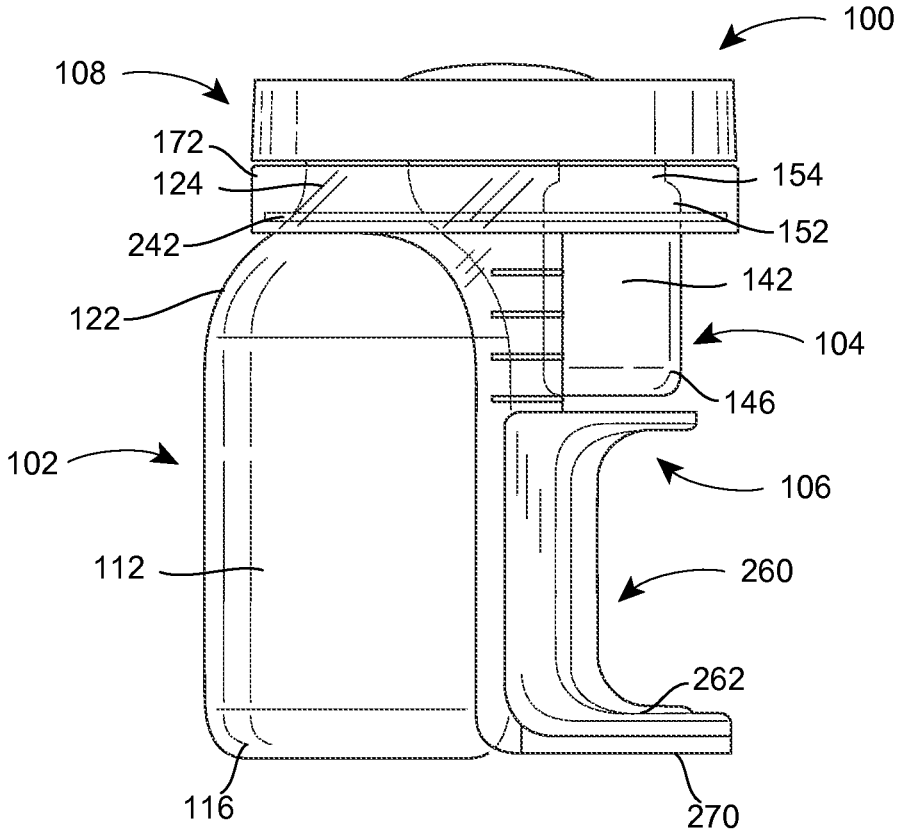
FIG. 4 is a side view of the device of FIG. 2.

In regard to the latch/recess pairs 176, 186 and 178, 188, these latch/recess pairs assist in securing the carrier 106 to and about the first and second containers 102, 104. According to the illustrated embodiment and as best seen in FIG. 3, the latch/recess pairs 176, 186 and 178, 188 may form trap-style locks, wherein the latches 176, 178 are disposed within the recesses 186, 188, such that the latches 176, 178 are trapped therein and unable to be removed from the recesses 186, 188 without the use of tools, and preferably not with the use of hands alone, for example. While a trap-style lock is illustrated in FIG. 3, one of skill in the art will appreciate that other locks or latches may be used that still fall within the scope of the present disclosure.

The carrier 106, and in particular the carrier pieces 170, 172, may include other features as well.

Figure 10:
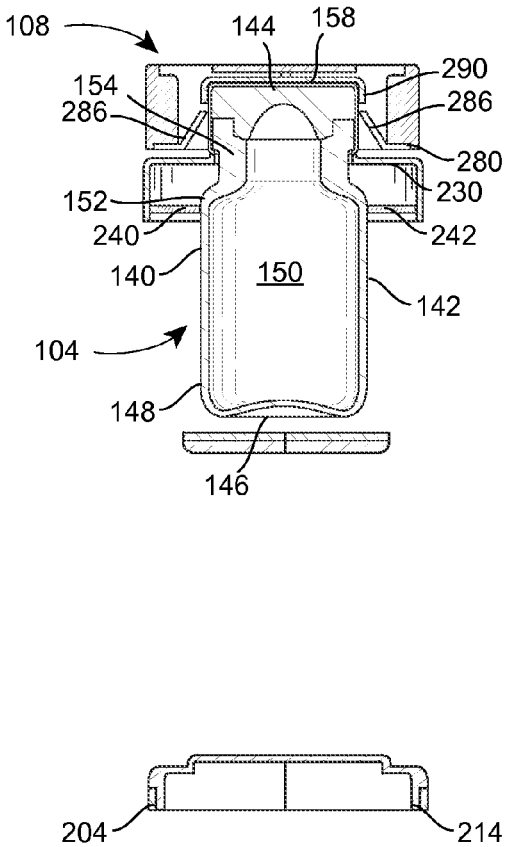
FIG. 10 is a cross-sectional view taken along the line 10-10 of FIG. 9.
Figure 11:
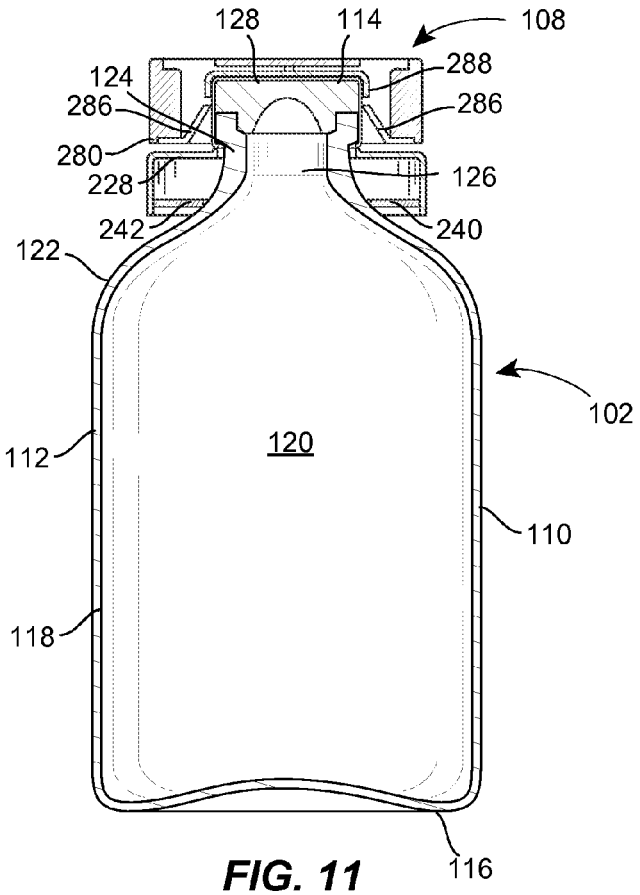
FIG. 11 is a cross-sectional view taken along the line 11-11 of FIG. 9.
Figure 12:
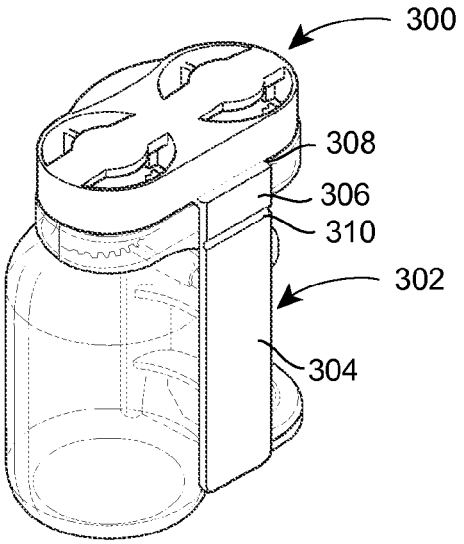
FIG. 12 is a perspective view of an alternative device according to the present disclosure, including a top cap having a folding lever used to remove the top cap.

For example, as illustrated, the top portions 200, 210 of the first and second carrier pieces 170, 172 may each include a section 220, 222, 224, 226 (see FIG. 1) of a collar 228, 230 (see FIGS. 2, 10 and 11). The collars 228, 230 may engage the containers 102, 104 to secure the carrier 106 to the containers 102, 104. For example, as illustrated, the collars 228, 230 of the carrier 106 may engage the region of the neck 124, 154 of each of the containers 102, 104, for example.

As will also be recognized from FIGS. 10 and 11, for example, the tops 114, 144 of the containers 102, 104 are disposed on a common level. That is, the tops 114, 144 of the containers 102, 104 are disposed in a common plane that is disposed at a distance from a surface on which the bottom 116 of the container 102 and the base portions 204, 214 of the carrier 106 are disposed (i.e., at a common distance in the vertical dimension). This is the case despite the size difference of the containers 102, 104 in the vertical dimension according to the illustrated embodiment. However, because the containers 102, 104 are similarly-sized relative to the distance between the necks 124, 154 and the tops 114, 144 in the vertical dimension, the disposition of the tops 114, 144 of the containers 102, 104 at a common level may be achieved by having the collars 228, 230 arranged in a common plane. As a further consequence, the features of the containers 102, 104, such as the flip caps 128, 158, are also disposed on a common level. Arrangement of the tops 114, 144 at a common level may simplify the construction of and facilitate the use of the top cap 108, as well as potentially facilitate administration of the drugs disposed in the containers 102, 104, although it is not a requirement for all embodiments according to the present disclosure to have the tops 114, 144 of the containers (or other features) disposed on a common level.

Also according to the present disclosure, each of the first and second carrier pieces 170, 172 may include a stabilizer 240, 242 (see FIGS. 2, 4, 6, 10 and 11). The stabilizer 240 is adapted to engage the front or first portion 110 of the first container 102 and a front or first portion 140 of the second container 104 (see FIGS. 2, 6, 10 and 11). The stabilizer 242 is adapted to engage the back or second portion 112 of the first container 102 and a back or second portion 142 of the second container 104 (see FIGS. 4, 6, 10 and 11).

Figure 6:
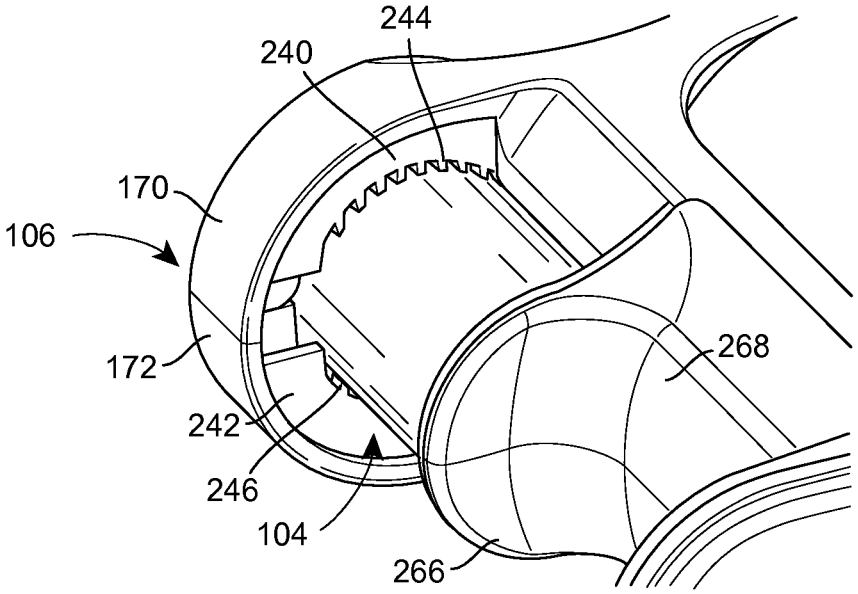
FIG. 6 is an enlarged, fragmentary perspective view of the device of FIG. 2, illustrating stabilizers engaging a wall of one of the containers.

Referring now specifically as to FIG. 6, it will be recognized that the stabilizer 240 of the first carrier piece 170 may be disposed at the top portion 200 of the first carrier piece 170, and the stabilizer 242 may similarly be disposed at the top portion 210 of the second carrier piece 172. Both stabilizers 240, 242 may include a plurality of projections 244, 246. The stabilizers 240, 242 and plurality of the projections 244, 246 that define, at least in part, the stabilizers 240, 242 may be made of a soft and/or flexible material and may engage the containers 102, 104, such that noise caused by movement of the containers 102, 104 relative to the carrier 106 is reduced, if not eliminated. In addition, the stabilizers 240, 242 and plurality of projections 244, 246 may also resist or limit rotation of the containers 102, 104 relative to the carrier 106.

Returning to FIG. 1, it will be recognized that to stabilize the carrier 106, the central portion 202 of the first carrier piece 170 includes a post 250, and the central portion 212 of the second carrier piece 172 includes a recess 252 in which the post 250 is disposed. As illustrated in FIG. 1, the post 250 may be cylindrical in shape, for example. As also illustrated in FIG. 1, the recess 252 may be a circular in shape. As it will be recognized, the post 250 and recess 252 may take the form of various other shapes, for example, and still fall within the scope of the present disclosure.

It will also be recognized that because the carrier 106, and in particular the collars 228, 230, holds the containers 102, 104 so that the tops 114, 144 of each are at a common level and because the containers 102, 104 are not of an equal size, there is a space 260 located opposite the container 102 beneath the container 104. A grip 262 is disposed in the space 260 (see FIG. 2). The grip 262 is thus beneath or below the second container 104 relative to the top cap 108, and opposite to the first container 102. The grip 262 may be formed of a soft material, such as molded plastic, that enables a user to securely grasp the containers 102, 104 and the carrier 106. More specifically, a user's fingers and/or a portion of a user's hand may grasp the soft grip 262 with the container 102 disposed in the palm of the user's hand.

As best illustrated in FIG. 1, the grip 262 is formed of a first grip portion 264 that is disposed on the first carrier piece 170 and a second grip portion 266 that is disposed on the second carrier piece 172. When the first carrier piece 170 is attached to the second carrier piece 172, the first grip portion 264 mates with the second grip portion 266 to define the grip 262 of the system 100, as illustrated in FIG. 2.

Finally, with reference to FIG. 5, the system 100 further includes a skid pad 270 that is disposed on bottom surfaces 272, 274 of the first and second carrier pieces 170, 172, respectively. More specifically, the bottom surface 272 of the first carrier piece 170 includes a skid pad portion 276, and the bottom surface 274 of the second carrier piece 172 includes a skid pad portion 278. When the first and second carrier pieces 170, 172 are connected, the skid pad portion 276 of the first carrier piece 170 mates with the skid pad portion 278 to define the skid pad 270. The skid pad 270 limits movement of the containers 102, 104 in a lateral direction, for example, when the system 100 is disposed on hard surfaces.

The first and second carrier pieces 170, 172 may each be made, in whole or in part, of a clear material that allows a user to view the first and second containers 102, 104 through the first and second carrier pieces 170, 172. Clear may be defined as transparent, translucent, or opaque, for example. In one example, the first and second carrier pieces 170, 172 may each be made of a plastic resin, such as copolyester, which combines high clarity with acceptable mechanical properties. One of the skill in the art will appreciate that various other materials may also be used that allow the first and second containers 102, 104 to be viewed through the first and second carrier pieces 170, 172.

Referring back to FIG. 1, the system 100 also includes the top cap 108 that is attached to the flip caps 128, 158 of the first and second containers 102, 104, respectively, to further secure the first and second containers 102, 104 together. More specifically, the top cap 108 is attached to the container flip caps 128, 158 after the first and second carrier pieces 170, 172 are disposed about the containers 102, 104. The top cap 108 is also attached to the flip caps 128, 158 so as to simultaneously remove the flip caps 128, 158 from the containers 102, 104 when the top cap 108 is removed.

As illustrated in FIGS. 7, 8, 10 and 11, to attach the top cap 108 to the flip caps 128, 158, the top cap 108 includes at least one fastener 280 that is adapted to secure the top cap 108 to at least one of the flip caps 128, 158. To this end, the top cap 108 has an underside 282 that includes two circular recesses 284. About each of the recesses 284 is disposed a fastener 280. More specifically, each fastener 280 includes a snap ring defined by at least one at least one tab 286 that engages an edge 288, 290 one of the flip caps 128, 158 (see FIGS. 7, 10, and 11). As illustrated, each fastener 280 includes four tabs 286 spaced approximately equally about the periphery of the circular recess 284, although it will be recognized that this is merely an illustrative and non-limiting example according to the present disclosure.

According to the embodiment illustrated in FIGS. 1-11, the top cap 108 also includes a central area 292 with a tab 294 that provides a mechanism for removing the top cap 108 with the flip caps 128, 158 from the carrier 106. In particular, it will be recognized that application of an upwardly directed force using a thumb or finger applied to the tab 294 will cause the top cap 108 to separate from the remainder of the system 100. However, the tab 294 represents but a single option for removing the top cap 108 from the remainder of the system 100.

For example, with reference to FIGS. 12-15, an alternative top cap 300 is provided with a mechanism for removal that does not rely upon application of force to a similarly situated and shaped tab. Instead, the top cap 300 includes a hinged lever 302 that may be attached to the remainder of the top cap 300, and that may be folded so that an upwardly directed force may be applied to the top cap 300 to separate the top cap 300 from the remainder of the system 100. As illustrated, the lever 302 may be formed integrally (i.e., as one piece) with the top cap 300, although this need not be the case according to all embodiments of the top cap 300 and lever 302 according to the present disclosure.

Figure 14:
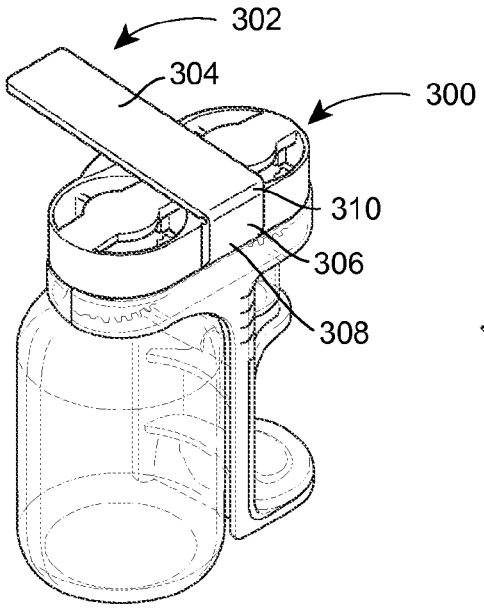
FIG. 14 is a perspective view of the device of FIG. 12, with the folding lever disposed over the top cap.

In particular, the lever 302 depends from the top cap 300 along the side of the carrier 106 in a first, storage or pre-operative state. The lever 302 includes a main section 304 and a connecting section 306, which sections 304, 306 are joined to each other and to the top cap 300 through hinges 308, 310. The hinges 308, 310 may be living hinges, as illustrated, and may be defined by sections of reduced thickness along the length of the lever 302. The lever 302 may be folded at the hinges 308, 310 so that the lever lies across the top cap 300, as illustrated in FIG. 14. With the lever 302 in the operative state illustrate in FIG. 14, a downwardly directed force may be applied to a first end 312 of the lever 302, applying an upwardly directed force to the opposite end of the lever 302 and the top cap 300, causing the top cap 300 (and associated flip caps) to separate from the remainder of the system (see FIG. 15).

Figure 13:
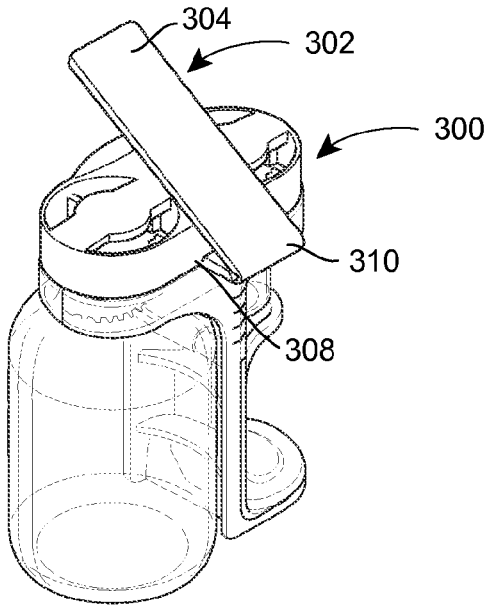
FIG. 13 is a perspective of view of the device of FIG. 12, with the folding lever bent upward and partially over the top cap.
Figure 15:
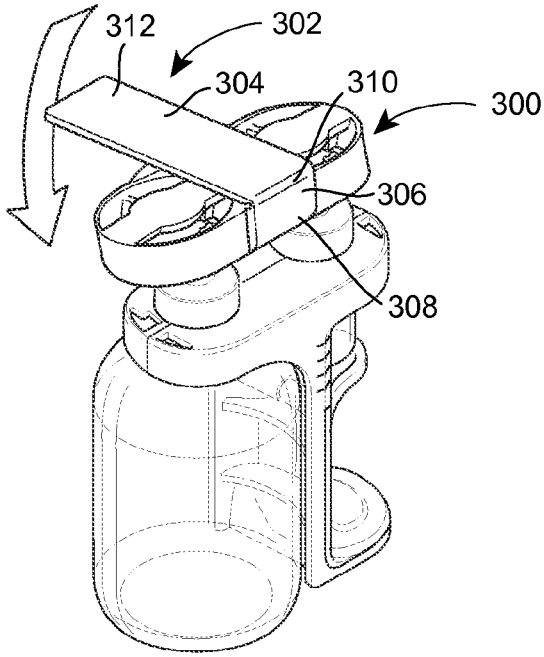
FIG. 15 is a perspective view of the device of FIG. 12, with a force applied the folding lever to remove the top cap.

To move the lever from the storage state to the operative state, the user first grips the main section 304, and applies an upwardly and outwardly directed force. This may cause the lever 302 to bend about one or both of the hinges 308, 310. As illustrated in FIG. 13, the force applied has caused the hinge 308 to bend approximately 90 degrees from the original position illustrated in FIG. 12, and the hinge 310 to bend almost 180 degrees, such that the main section 304 of the lever 302 overlies the connecting section 306. Further application of force causes further bending at the hinges 308, 310, such that the hinge 308 illustrated in FIG. 14 is now bent approximately 180 degrees from the original position illustrated in FIG. 12, while the hinge 310 is bent approximately 90 degrees to the connecting section 306, such that the main section 304 of the lever 302 now overlies the top cap 300. With the lever in its operative position, force may be applied as illustrated in FIG. 15 to separate the top cap 300 from the remainder of the system 100.

To assemble the system 100, the containers 102, 104 may be disposed such that the necks 124, 154 are received within the sections 220, 222 of the first carrier piece 170 or the sections 224, 226 of the second carrier piece 172. The carrier pieces 170, 172 may then be brought together such that the latches 174, 176, 178, 180, 182 are received in the recesses 184, 186, 188, 190, 192. With the latches 174, 176, 178, 180, 182 fully received within the recesses 184, 186, 188, 190, 192, the carrier pieces 170, 172 are connected to each other such that at least a portion (i.e., the necks 124, 154) of the containers 102, 104 is disposed therebetween such that the carrier 106 resists the separation of the containers 102, 104 from the carrier 106, and thus resists separation of the containers 102, 104 from each other. It may also be said that the carrier 106 is secured to the containers 102, 104. At this point, the top cap 108 may be disposed on the tops 114, 144 of the containers 102, 104, such that the fasteners 280 of the top cap 108 engage the flip caps 128, 158 of the containers 102, 104, at least at an edge 288, 290 of the containers 102, 104. At this point, it may also be said that the top cap 108 is secured to the flip caps 128, 158.

At the time of use, the containers 102, 104 will be associated with each other as a consequence of the carrier 106. To provide access to the contents of the containers 102, 104, an upwardly directed force may be applied to the tab 294 of the top cap 108 of the embodiment of FIGS. 1-11. Alternatively, a downwardly directed force may be applied to the lever 302 of the embodiment of FIGS. 12-15. In either event, the application of force causes the top cap 108 to separate from the remainder of the system 100, carrying away the flip caps 128, 158 that remain attached or secured to the top cap 108 as a consequence of the engagement of the fasteners 280 with the edges 288, 290 of the flip caps 128, 158.

It is believed that the container system according to the present disclosure may provide one or more advantages, one or more of which may be provided in a particular embodiment of the present disclosure. The system 100 assists in maintaining the association of the first container 102 and the second container 104 at least until use, and in ensuring that both flip caps 128, 158 of the first and second containers 102, 104 are opened together. As a result, the system 100 may also assist in decreasing the risk that the medication in both containers is inappropriately or incorrectly administered to a patient. Additional features may provide additional advantages. For example, the carrier 106, and in particular the grip 262, allows for easier handling of the containers 102, 104 during administration of the medication, for example. In addition, the skid pad 270 of the system 100 help stabilize the containers 102, 104 when they are placed on a surface, for example, making administration of the medication more efficient.

Although the foregoing text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for the sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §110, sixth paragraph.

It should be understood other changes and modifications to the presently preferred embodiments described herein would also be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A system comprising:

a first container having a wall defining a receptacle, a neck defining an opening, and a flip cap disposed over the opening;

a second container having a wall defining a receptacle, a neck defining an opening, and a flip cap disposed over the opening;

a carrier including first and second carrier pieces disposed about the first and second containers and attached together with the first and second containers locked therebetween; and a top cap attached to the flip caps to secure the first and second containers together and to simultaneously remove the flip caps from the containers, the top cap having a first state with the flip caps attached to the first and second containers and a second state with the flip caps removed from the first and second containers, the top cap changing from the first state to the second state in response to a force applied to the top cap.

2. The system of claim 1, the first and second carrier pieces each having a section of a collar that engages a portion of the first container or the second container, the collars engaging the first and second containers to secure the carrier to the first and second containers.

3. The system of claim 1, the first and second carrier pieces each having a stabilizer that engages a portion of the first container or the second container to reduce relative motion between the first and second containers and the carrier.

4. The system of claim 3, wherein the stabilizers each comprise a plurality of projections that engage the first container or the second container.

5. The system of claim 1, wherein the first and second carrier pieces are each made of a clear material.

6. The system of claim 1, wherein the first container has a top and the second container has a top, and the tops of the first and second containers are disposed on a common level.

7. A system comprising:

a first container having a wall defining a receptacle, a neck defining an opening, and a flip cap disposed over the opening;

a second container having a wall defining a receptacle, a neck defining an opening, and a flip cap disposed over the opening;

a carrier including first and second carrier pieces disposed about the first and second containers and attached together with the first and second containers secured therebetween; and a top cap attached to the flip caps to secure the first and second containers together and to simultaneously remove the flip caps from the containers;

wherein the first carrier piece includes a first latch disposed in a first recess on the second carrier piece, the first latch and the first recess disposed between the first and second containers with the first and second carrier pieces attached together, and wherein the first carrier piece includes second and third latches disposed in second and third recesses on the second carrier piece, the second latch and recess disposed on a first side of the first latch with the first container disposed between the first latch and recess and the second latch and recess, and the third latch and recess disposed on an opposite, second side of the first latch with the second container disposed between the first latch and recess and the third latch and recess.

8. The system of claim 7, wherein the first and second carrier pieces each have a top and a base, the first, second, and third latches disposed on the top of the first carrier piece and the first, second, and third recesses disposed on the top of the second carrier piece.

9. The system of claim 8, further comprising at least one latch disposed on the base of the first carrier piece and at least one recess disposed on the base of the second carrier piece, the at least one latch disposed on the base of the first carrier piece disposed in the at least one recess disposed on the base of the second carrier piece to attach the first and second carrier pieces together.

10. The system of claim 9, wherein the first carrier piece includes a post disposed between the top and the base and the second carrier piece includes a recess disposed between the top and the base, the post received within the base to stabilize the carrier.

11. A system comprising:

a first container having a wall defining a receptacle, a neck defining an opening, and a flip cap disposed over the opening;

a second container having a wall defining a receptacle, a neck defining an opening, and a flip cap disposed over the opening;

a carrier including first and second carrier pieces disposed about the first and second containers and attached together with the first and second containers secured therebetween; and a top cap attached to the flip caps to secure the first and second containers together and to simultaneously remove the flip caps from the containers;

wherein the first and second carrier pieces each have a top and a base, and further comprising a skid pad defined by a first skid pad portion disposed on the base of the first carrier piece and a second skid pad portion disposed on the base of the second carrier piece.

12. A system comprising:

a first container having a wall defining a receptacle, a neck defining an opening, and a flip cap disposed over the opening;

a second container having a wall defining a receptacle, a neck defining an opening, and a flip cap disposed over the opening;

a carrier including first and second carrier pieces disposed about the first and second containers and attached together with the first and second containers secured therebetween; and a top cap attached to the flip caps to secure the first and second containers together and to simultaneously remove the flip caps from the containers;

wherein the top cap comprises at least two snap rings, each snap ring including at least one tab, the at least one tab attaching the top cap to the flip cap of one of the first and second containers, wherein the top cap comprises a hinged lever having a storage state disposed along the carrier, and an operative state disposed across the top cap.

13. A system comprising:

a first container having a wall defining a receptacle, a neck defining an opening, and a flip cap disposed over the opening;

a second container having a wall defining a receptacle, a neck defining an opening, and a flip cap disposed over the opening;

a carrier including first and second carrier pieces disposed about the first and second containers and attached together with the first and second containers secured therebetween; and a top cap attached to the flip caps to secure the first and second containers together and to simultaneously remove the flip caps from the containers;

wherein the carrier includes a grip disposed opposite the first container and below the second container relative to the top cap, the grip defined by a first grip portion disposed on the first carrier piece and a second grip potion disposed on the second carrier piece.

* * * * *

UNITED STATES PATENT AND TRADEMARK OFFICE

CERTIFICATE OF CORRECTION

PATENT NO. : 8,684,433 B2
APPLICATION NO. : 13/456341
DATED : April 1, 2014
INVENTOR(S) : Thomas Oesterle et al.

It is certified that error appears in the above-identified patent and that said Letters Patent is hereby corrected as shown below:

In the Claims:

At Column 11, line 1, "potion" should be -- portion --.

Signed and Sealed this
Twelfth Day of May, 2015

Michelle K. Lee

Michelle K. Lee
*Director of the United States Patent and Trademark Office*